United States Patent [19]

Budzich

[11] 4,330,991

[45] May 25, 1982

[54] LOAD RESPONSIVE SYSTEM CONTROLS

[76] Inventor: Tadeusz Budzich, 80 Murwood Dr., Moreland Hills, Ohio 44022

[21] Appl. No.: 109,053

[22] Filed: Jan. 2, 1980

[51] Int. Cl.[3] ..... F15B 13/02

[52] U.S. Cl. ..... 60/427; 60/450; 60/452; 91/451; 137/596.13

[58] Field of Search ..... 60/427, 450, 452; 91/451; 137/596.13

[56] References Cited

U.S. PATENT DOCUMENTS

Re. 29,538 2/1978 Budzich ..... 91/446 X 4,122,865 10/1978 Budzich ..... 137/596.13

4,282,898 8/1981 Harmon et al. ..... 137/596.13

*Primary Examiner*—Gerald A. Michalsky

[57] ABSTRACT

Load responsive system controls to vary output flow control of a system pump to control the pressure differential, acting across a control orifice positioned between system pump and a fluid motor. The system controls permit variation in the level of pressure differential in response to an external control signal, while this pressure differential is maintained constant at each controlled level.

56 Claims, 15 Drawing Figures

LOAD RESPONSIVE SYSTEM CONTROLS

BACKGROUND OF THE INVENTION

This invention relates generally to load responsive system controls, which permit variation in the level of control differential between pump discharge pressure and the load pressure signal, while this control differential is automatically maintained constant at each controlled level.

In more particular aspects this invention relates to load responsive system controls, which permit variation in the controlled pressure differential between pump discharge pressure and the load pressure, in response to an external control signal.

In still more particular aspects this invention relates to signal modifying controls of a load responsive system, which supply control signals to output flow control of a pump, to adjust and regulate the pressure differential across an orifice positioned between the system pump and a fluid motor operating a load.

Load responsive systems, in which pump output flow controls respond to load pressure signal to maintain a constant pressure differential between pump discharge pressure and load pressure, are well known in the art. In such a control system flow through an orifice, positioned between system pump and fluid motor operating a load, is proportional to the area of the orifice and independent of system load. Such load responsive systems are very desirable for a number of reasons. Not only do they provide exceptional control of a load, but they permit operation of the load at very high system efficiency. Such load responsive fluid control systems are shown in U.S. Pat. No. 2,892,312 issued to Allen et al and my U.S. Pat. No. 3,444,689 dated May 20, 1969. One disadvantage of such systems is the fact that, once the control pressure differential is selected and incorporated into system design, it will remain constant under all operating conditions of the system. Adjustment of the controlled level of the system differential, in respect to system flow, pressure, or specific conditions relating to control of a load, would not only improve the control characteristics of the system, improve the system efficiency, but would also make possible independent adjustments in the system performance, while the system load is controlled by a load responsive direction control valve.

SUMMARY OF THE INVENTION

It is therefore a principle object of this invention to provide improved load responsive system controls, which permit variation in the level of control differential, between pump discharge pressure and the load pressure, while this control differential is automatically maintained constant at each controlled level.

Another object of this invention is to provide load responsive system control, in which control of system load can be either accomplished by variation in area of orifice between the system pump and a fluid motor, while the pressure differential across this orifice is maintained constant at a specific level, or by control of pressure differential, acting across this orifice while area of the orifice remains constant.

It is a further object of this invention to provide load responsive system controls, which permit variation in the controlled pressure differential across a metering orifice in response to an external control signal.

It is a further object of this invention to provide load responsive system controls, in which an external control signal, at a minimum force level, can adjust and control the pressure differential, acting across a metering orifice of a load responsive direction control valve, while the system load is being controlled by variation in area of the metering orifice.

It is a further object of this invention to provide a control of a load responsive system, which modifies control signals, supplied to output flow control of a pump, to control the pressure differential across an orifice, positioned between the system pump and a fluid motor operating a load.

Briefly the foregoing and other additional objects and advantages of this invention are accomplished by providing novel load responsive system controls to vary the level of control differential between pump discharge pressure and the load pressure while this control differential is automatically maintained constant at each controlled level by load responsive pump control. This control action, responsive to an external control signal can be superimposed upon conventional constant pressure differential control of a load responsive system, providing a system with dual parallel control inputs. In this way not only the level of the controlled pressure differential can be adjusted to any desired value, during conventional mode of operation of the load responsive control, but the load can be fully controlled through change in the control differential, in any control position of the load responsive direction control valve.

Additional objects of this invention will become apparent when referring to the preferred embodiments of the invention as shown in the accompanying drawings and described in the following detailed description.

Figure 6:
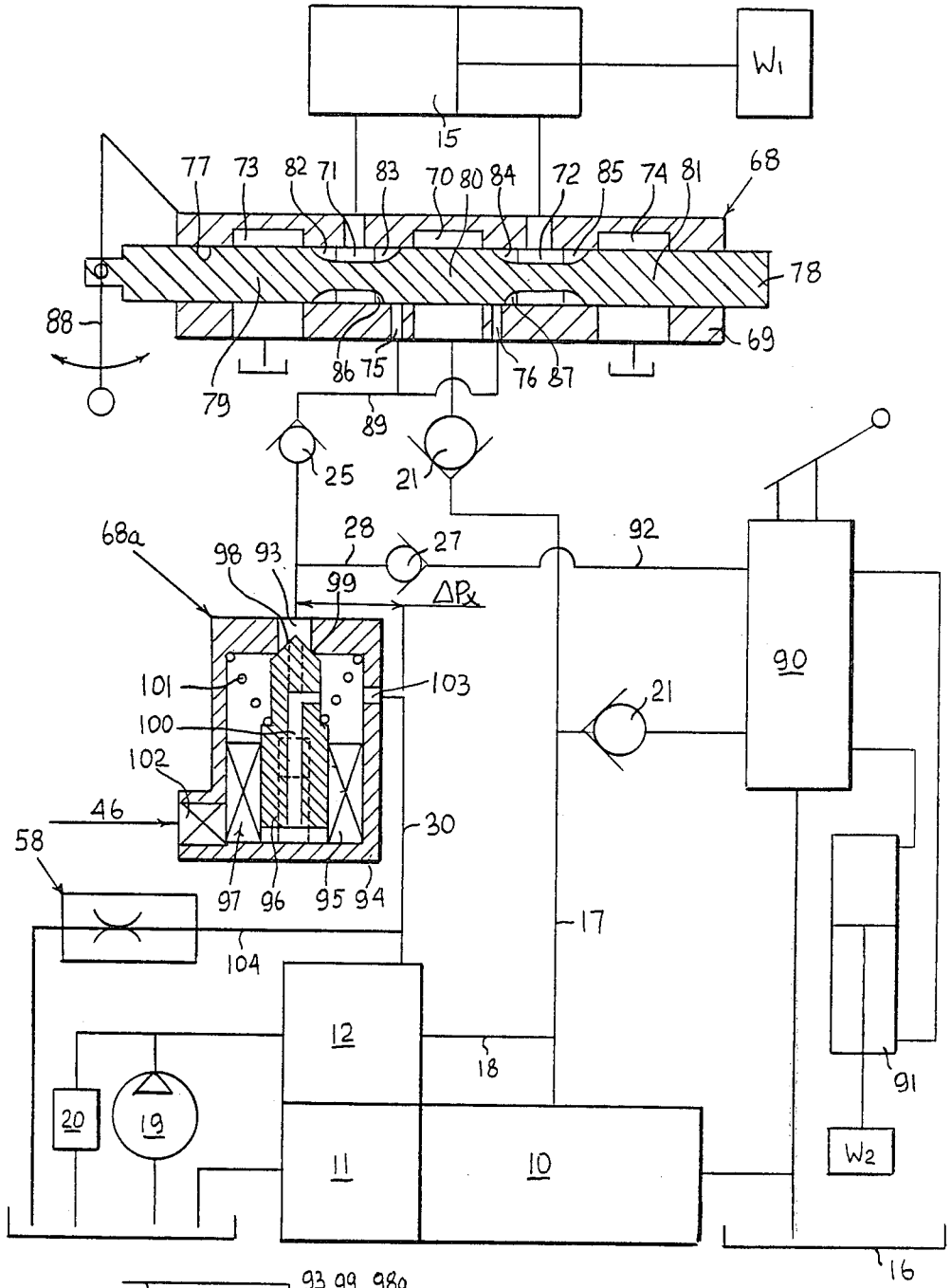
FIG. 6 is a diagramatic representation of load responsive control of FIG. 5 in combination with diagramatically shown load responsive direction control valve and different type of differential throttling valve.
Figure 7:
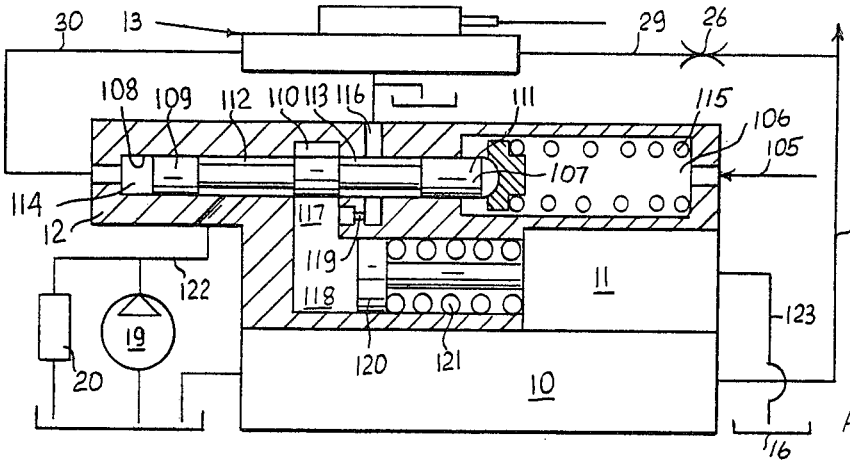
Figure 8:
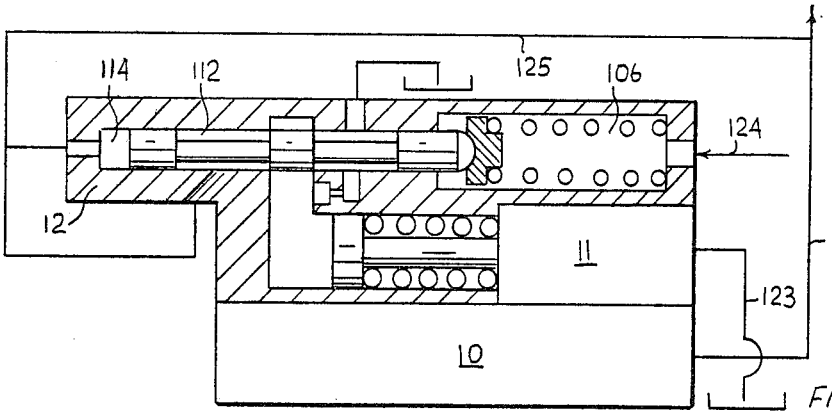
Figure 9:
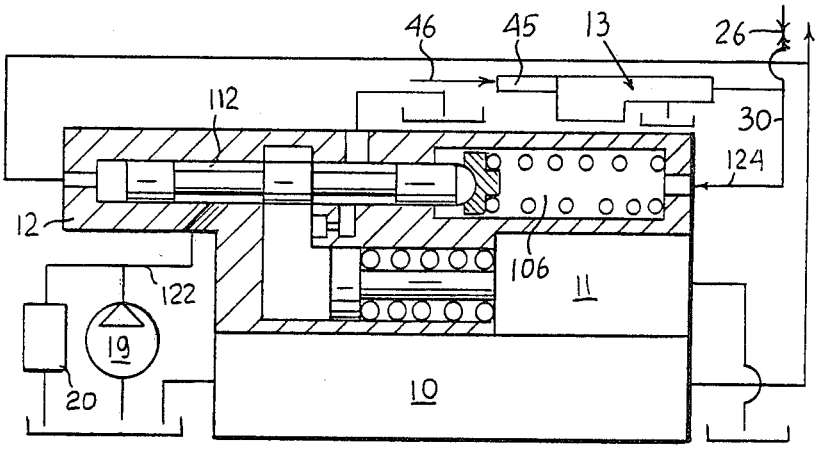
Figure 10:
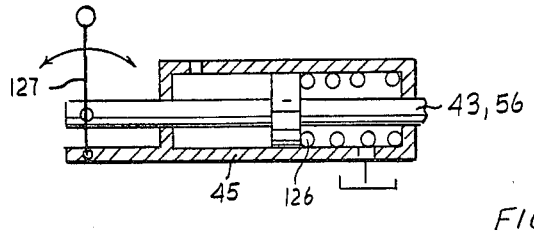
Figure 11:
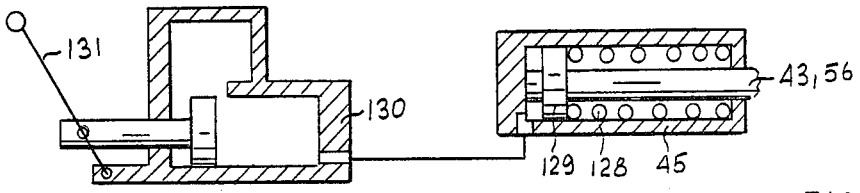
Figure 12:
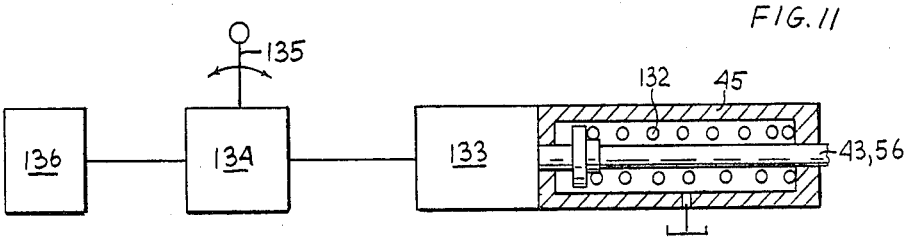
Figure 13:
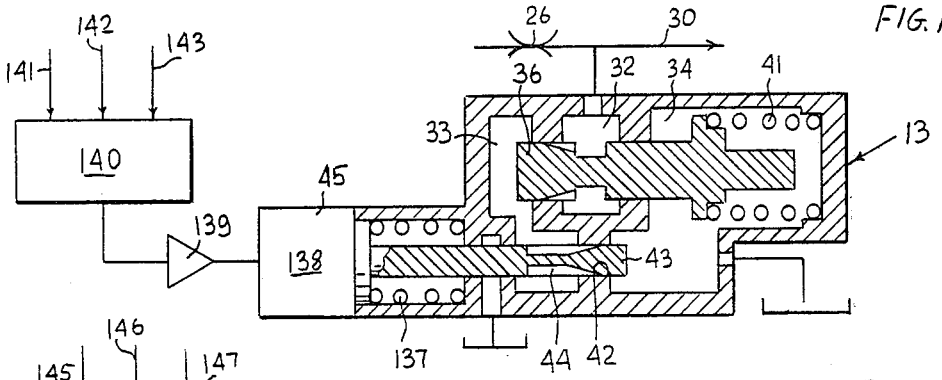
Figure 14:
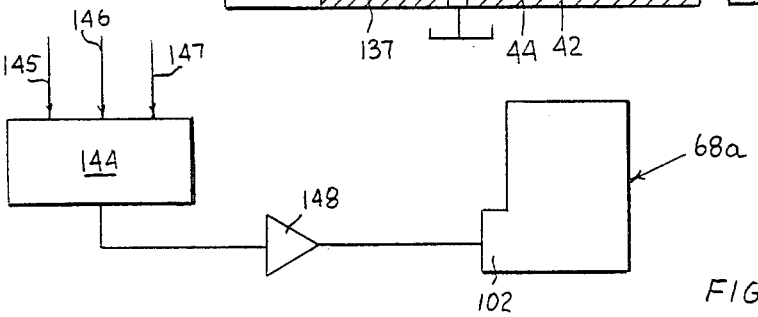

FIG. **6*a* is a diagramatic representation of the differential pressure controller of FIG. 6** provided with fixed preselected pressure differential;

FIG. 7 is a diagramatic representation of one arrangement of load responsive pump controls;

FIG. 8 is a diagramatic representation of another arrangement of load responsive pump controls;

FIG. 9 is a diagramatic representation of still another arrangement of load responsive pump controls;

FIG. 10 is a diagramatic representation of manual control input into load responsive controls of FIGS. 1, 3, 4 and 5;

FIG. 11 is a diagramatic representation of hydraulic control input into load responsive controls of FIGS. 1, 3, 4 and 5;

FIG. 12 is a diagramatic representation of electromechanical control input into load responsive controls of FIGS. 1, 3, 4 and 5;

FIG. 13 is a diagramatic representation of electrohydraulic control input into load responsive controls of FIGS. 1, 3, 4 and 5;

FIG. 14 is a diagramatic representation of an electromechanical control input into load responsive system of FIG. 6.

DESCRIPTION OF THE PREFERRED EMBODIMENT

Figure 1:
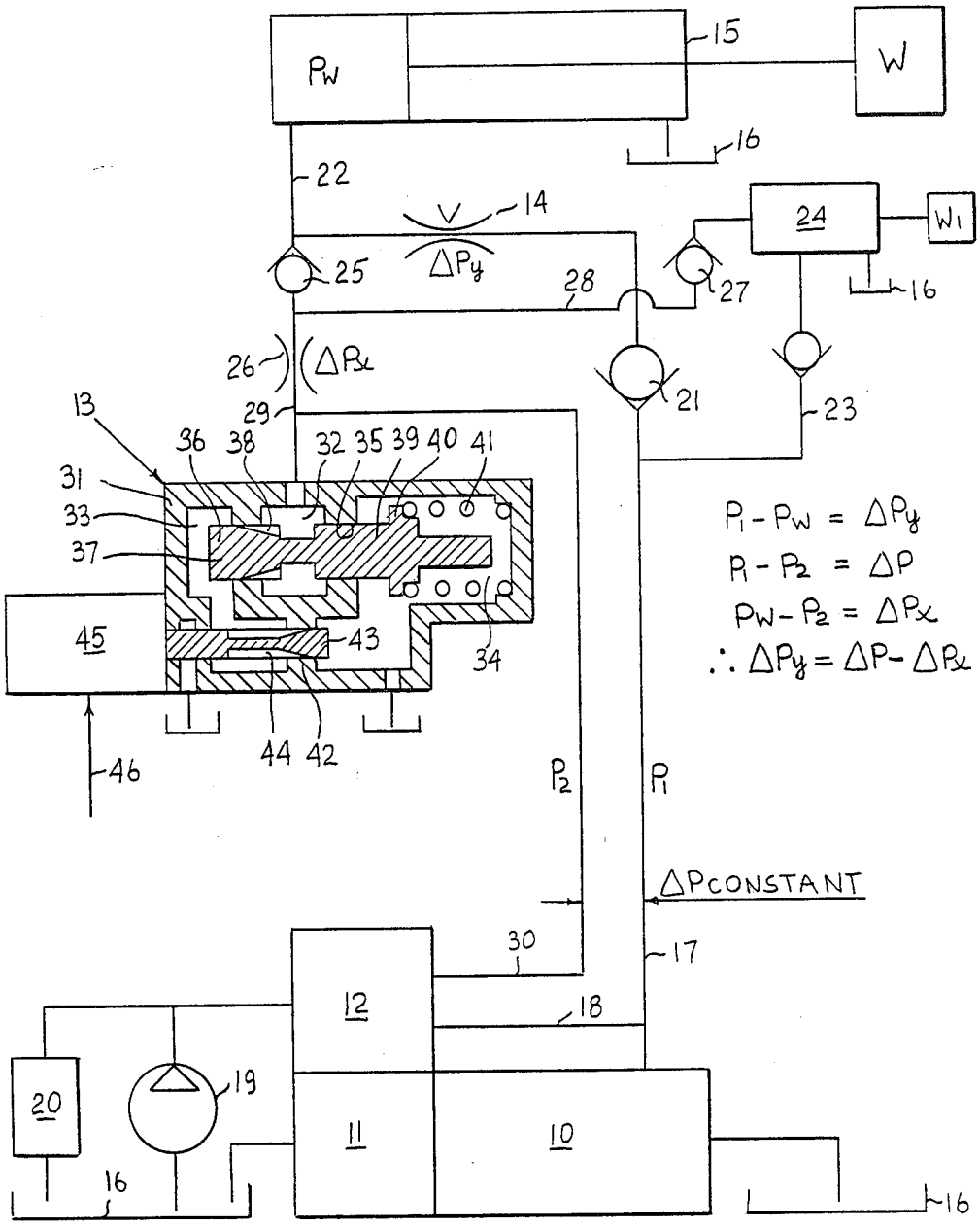
FIG. 1 is a diagramatic representation of load responsive control for adjustment in level of control differential from a certain preselected level to zero level, with fluid motor, system pump and pump controls shown schematically.

Referring now to FIG. 1, the hydraulic system shown therein comprises a fluid pump 10, equipped with a flow changing mechanism 11, operated by an output flow control 12. The output flow control 12 regulates delivery of the pump 10 into a load responsive circuit, composed of a differential control, generally designated as 13, regulating the level of pressure differential developed across schematically shown variable orifice 14, interposed between the pump 10 and a fluid motor 15 operating load W. The pump 10 may be of fixed or variable displacement type. With the pump 10 being of fixed displacement type, the output flow control 12, in a well known manner, regulates, through flow changing mechanism 11, delivery from pump to load responsive circuit, by bypassing part of the pump flow to a system reservoir 16. With the pump 10 being of variable displacement type the output flow control 12, in a well known manner, regulates through flow changing mechanism 11 delivery from pump to load responsive circuit, by changing the pump displacement. Although in FIG. 1, for purposes of demonstration of the principle of the invention, the differential control 13 is shown separated, in actual application the differential control 13 would be most likely an integral part of pump output flow control 12. The output flow control 12 may be supplied with fluid energy from the pump 10 through discharge line 17 and line 18, or from a separate source of fluid energy, namely a pump 19 provided with a bypass valve 20. Discharge line 17 of pump 12 is connected through a load check 21, variable orifice 14 and line 22 to the fluid motor 15 and through line 23 to a fluid motor 24, subjected to load $W_1$. Load pressure signal Pw is transmitted through line 22 and a signal check valve 25 to fixed or variable orifice 26. Similarly, load pressure signal from the fluid motor 24 is transmitted through a signal check valve 27 and line 28 to upstream of fixed or variable orifice 26 and down stream of signal check valve 25. The differential control 13 communicates through line 29 with down stream of fixed or variable orifice 26 and through line 30 with the output flow control 12 of pump 10.

The differential control, generally designated as 13, comprises a housing 31 having an inlet chamber 32, a control chamber 33 and an exhaust chamber 34, interconnected by bore 35, guiding a control spool 36. The control spool 36 is equipped with a land 37 provided with throttling slots 38 and positioned, between control and inlet chambers, a land 39 separating inlet and exhaust chambers and a flange 40. A control spring 41 is interposed in the exhaust chamber between the flange 40 of control spool 36 and the housing 31. The exhaust chamber 34 and the control chamber 33 are selectively interconnected by metering orifice, created by a stem 43 guided in circular bore 42 and provided with metering slots 44. The stem 43 is connected to an actuator 45, responsive to external control signal 46.

Figure 2:
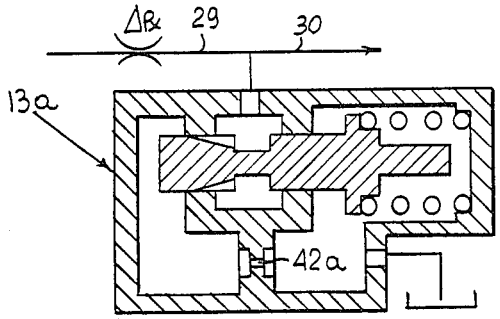
FIG. 2 is a diagramatic representation of the differential pressure controller of FIG. 1 provided with a fixed orifice.

Referring now to FIG. 2, a differential pressure control 13*a* of FIG. 2 is identical to the differential control 13 of FIG. 1, with the exception that metering orifice 42 and the stem 43 with its metering slots 44 were substituted by fixed orifice 42*a*.

Figure 3:
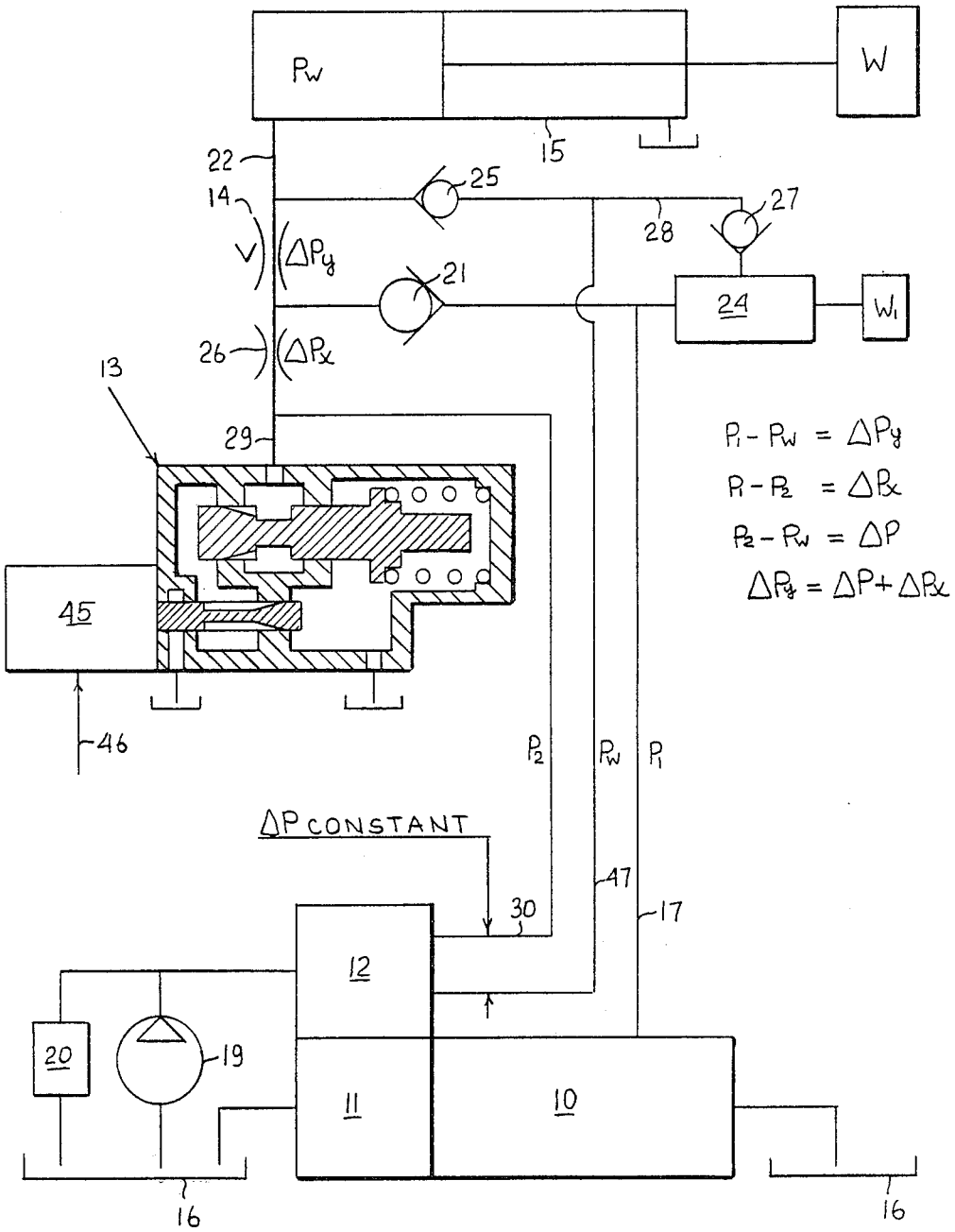
FIG. 3 is a diagramatic representation of load responsive control for adjustment in the level of control differential from a certain minimum preselected value up to maximum level, with fluid motor, system pump and pump controls shown schematically.

Referring now to FIG. 3, the same components used in FIG. 1 are designated by the same numerals. The only difference between load responsive system controls of FIGS. 1 and 3 is the phasing of the differential control 13 and the load pressure signals from fluid motors 15 and 24 to the output flow control 12 of pump 10. In FIG. 3 the load pressure signal from down stream of signal check valves 25 and 27 is directly transmitted through line 47 to the output flow control 12. The discharge pressure signal from pump 10 is transmitted to the output flow control 12, through discharge line 17, load check 21, fixed or variable orifice 26 and line 30, with differential control 13 connected to this signal transmitting path.

Figure 4:
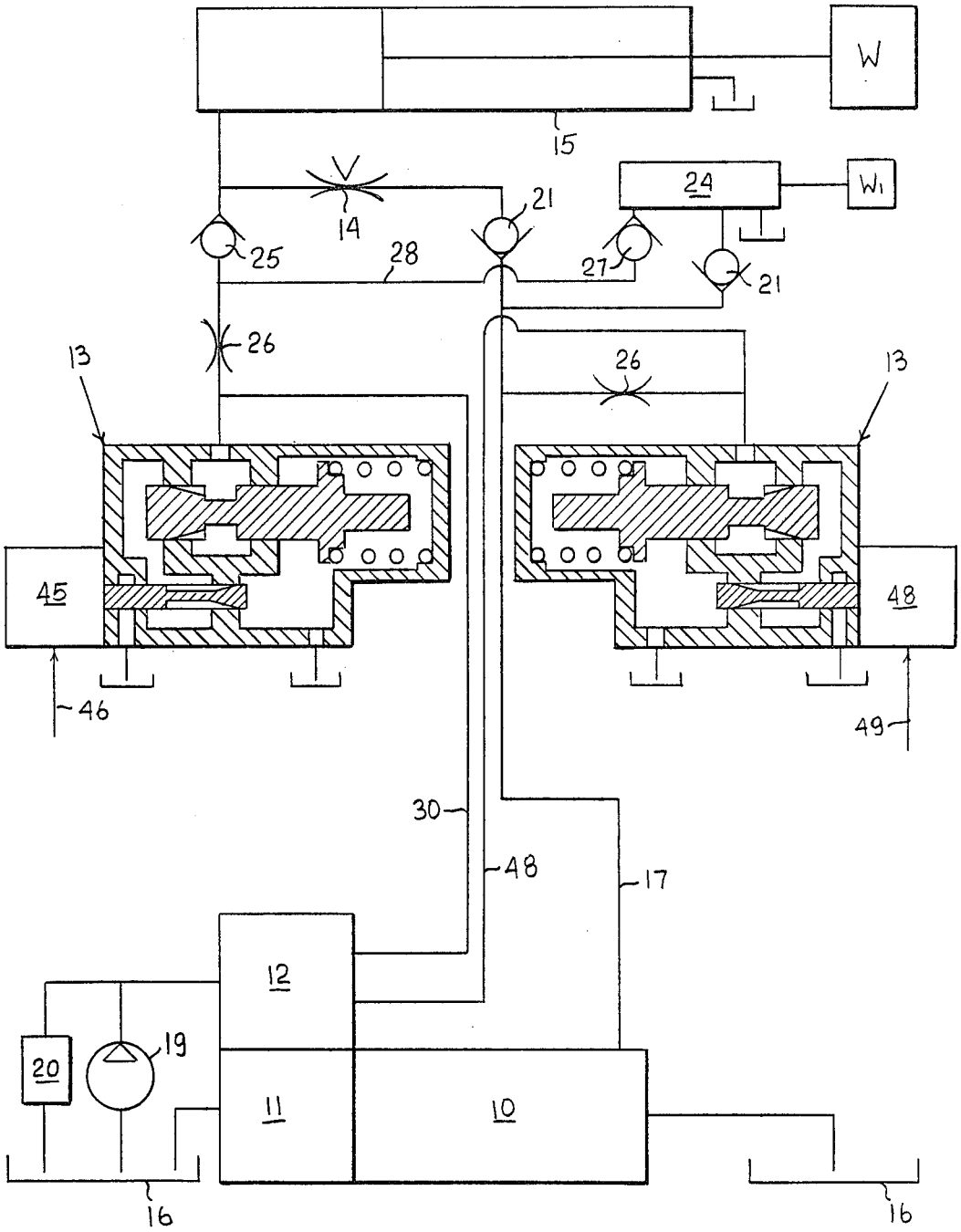
FIG. 4 is a diagramatic representation of combined load responsive controls of FIGS. 1 and 3 with fluid motor, system pump and pump controls shown schematically.

Referring now to FIG. 4, the same components used in FIGS. 1 and 3 are designated by the same numerals. The load responsive system of FIG. 4 shows one differential control 13 connected to signal transmitting line 30 in the same way as in the circuit of FIG. 1 and a second differential control 13 connected to signal transmitting line 48 in the same way as in the circuit of FIG. 3.

Figure 5:
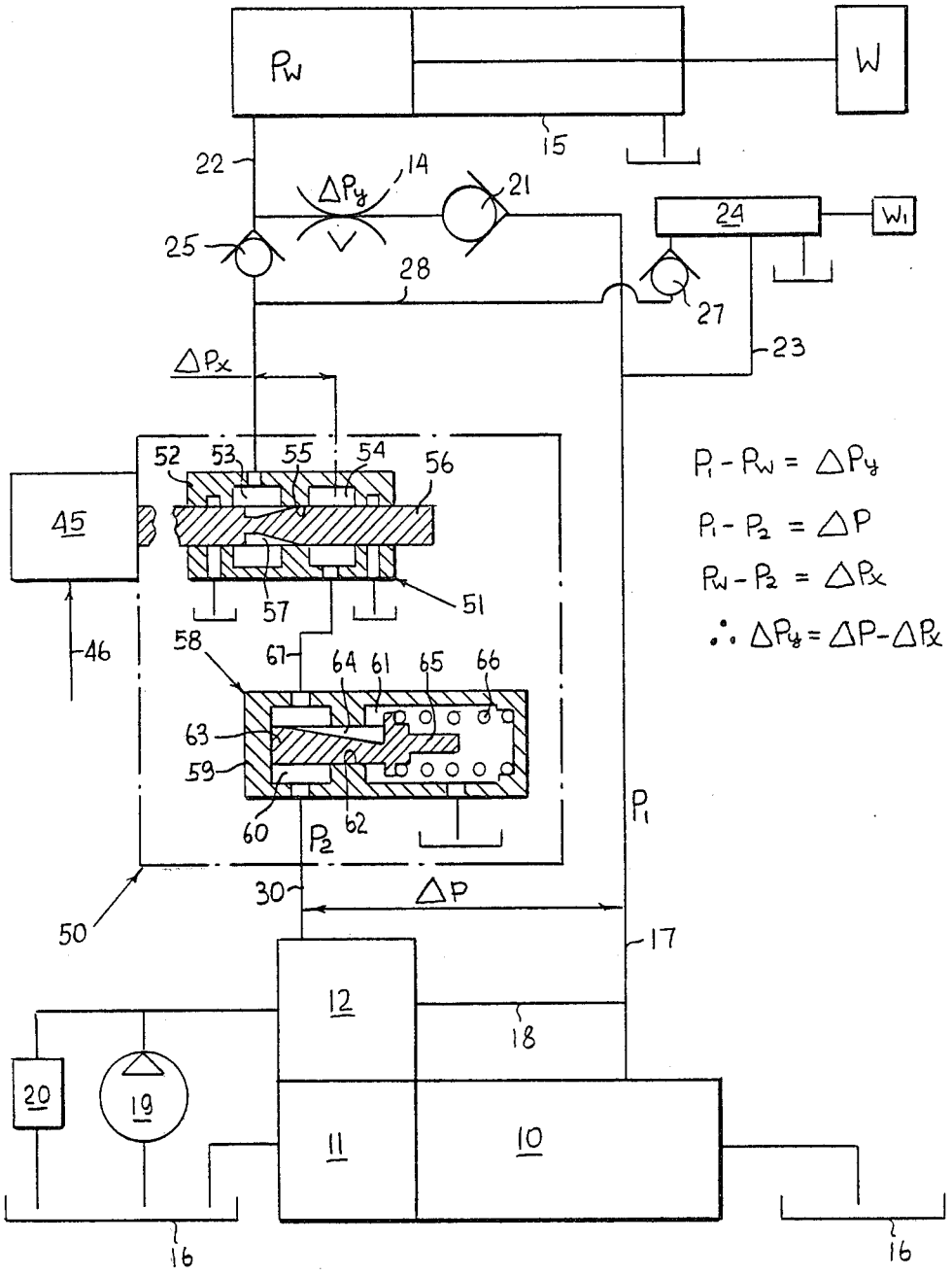
FIG. 5 is a diagramatic representation of another embodiment of load responsive control of FIG. 1, with fluid motor, system pump and pump controls shown schematically.

Referring now to FIG. 5, the same components used in FIG. 1 are designated by the same numerals. The basic load responsive circuit of FIG. 5 and all of the system components, with the exception of differential control assembly, generally designated as 50, are identical to those of FIG. 1. The differential control assembly 50 of FIG. 4 is phased into the circuit in the same way as the differential control 13 of FIG. 1 and performs an identical function. Although the differential control assembly 50 is shown for purposes of better demonstration, composed of two components, those two components should be combined and preferably incorporated into assembly of output flow control 12. The differential control assembly 50 includes a variable orifice valve 51, provided with a housing 52, having an inlet chamber 53, an outlet chamber 54, circular bore 55, positioned between those chambers and guiding a stem 56 equipped with metering slot 57. The stem 56 is connected to the actuator 45 responsive to an external control signal 46. The differential control assembly 50 also includes a flow control valve 58, provided with a housing 59 having an inlet chamber 60 and an exhaust chamber 61, connected by bore 62, axially guiding a metering pin 63, provided with a metering slot 64. The metering pin 63 is provided with a stop 65 and is biased towards position as shown by a spring 66, contained in the exhaust chamber. The inlet chamber 53 of variable orifice valve 51 is connected by line 28 with down stream of signal check valves 25 and 27, while the outlet chamber 54 is connected by line 67 with the inlet chamber 60, of the flow control valve 58, which in turn is connected by line 30 with the output flow control 12 of pump 10.

Referring now to FIG. 6, the same components used in FIG. 5 are designated by the same numerals. The basic load responsive system of FIG. 6 is similar to the system of FIG. 5, with the exception that variable orifice 14 was substituted by a load responsive direction control valve, generally designated as 68 and a different type of a differential valve 68*a* was used. The direction control valve 68 comprises a housing 69 having an inlet chamber 70, first and second load chambers 71 and 72, first and second exhaust chambers 73 and 74, load pressure sensing ports 75 and 76 and bore 77, guiding a valve spool 78. The valve spool 78 has lands 79, 80 and 81 provided with metering slots 82, 83, 84 and 85 and signal slots 86 and 87 and is actuated by control lever 88. Load pressure sensing ports 75 and 76 are connected by line 89 to upstream of the signal check valve 25. In an identical way load pressure sensing ports of a load responsive direction control valve 90, controlling through fluid motor 91 load $W_2$, are connected by a line to upstream of the signal check valve 27. Down stream of signal check valves 25 and 27 is connected by line 28 to inlet port 93 of differential valve, generally designated as 68*a*. The differential valve 68*a* comprises a housing 94, retaining a coil 95, guiding an armature 96 of a solenoid, generally designated as 97. The armature 96 is provided with a conical surface 98 selectively engagable with the sealing edge 99 of the inlet port 93 and venting passage 100. A retaining spring 101 can be interposed between the armature 96 and the housing 94. The coil 95 is connected by a sealed connector 102 to outside of the housing 94, external signal 46 being applied to the sealed connector 102. The outlet port 103 of the differential valve 68*a* is connected by line 30 with the output flow control 12 and is also connected by line 104 with orifice leading to the reservoir 16. The orifice can be of a fixed or variable type. If the orifice is of a variable type it may be of a type and contained within the flow control valve 58 of FIG. 5, construction of which was described in detail when referring to FIG. 5.

Figure 6A:
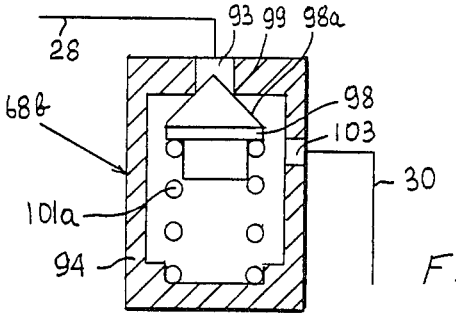

Referring now to FIG. 6*a*, a differential pressure controller 68*b* is similar to the differential controller 68*a* of FIG. 6, with the exception that the throttling member 98, with its conical surface 98*a* engaging sealing edge 99, is biased by a spring 101*a* instead of by armature 96.

Referring now to FIG. 7, the variable output flow pump 10 of FIGS. 1, 3, 4, 5 and 6 is provided with the flow changing mechanism 11 and the output flow control 12. First pressure control signal is transmitted from discharge line 17, through fixed or variable orifice 26, line 29, the differential control 13 and line 30 to the output flow control 12, as per control arrangement shown in FIG. 3. A second pressure control signal 105 is transmitted directly from the largest system load to control space 106 of the output flow control 12. The output flow control 12, well known in the art, comprises a pilot valve 107, guided in a bore 108 and equipped with lands 109, 110 and 111, defining annular spaces 112, 113 and space 114. The pilot valve 107 is biased by a control spring 115, contained within control space 106. Bore 108 is provided with an exhaust core 116, connected to the system reservoir 11 and a control core 117, connected to a chamber 118 and through leakage orifice 119 also connected to the exhaust core 116. The chamber 118 contains a piston 120 operating the flow changing mechanism 11 and biased by a spring 121. Annular space 112 is connected by line 122 with discharge pressure of the pump 19 and the flow changing mechanism 11 is connected by line 123 with the system reservoir 16.

Referring now to FIG. 8, the basic arrangements of the flow changing mechanism 11 and the output flow control 12 of the fluid pump 10 are the same, as those shown in FIG. 7, however, the output flow control 12 of FIG. 8 responds to different pressure control signals. Space 114 is directly connected by line 125 with the discharge line 17 and control space 106 is subjected to control pressure signal 124, which is a load pressure signal, modified by the differential control 13.

Referring now to FIG. 9, in FIG. 9 the basic arrangement of FIG. 8 is shown with the fluid energy for pump controls being supplied to annular space 112 from separate pump 19, instead of using energy supplied by the pump 10. FIG. 9 shows the pump controls connected into basic system as shown in FIG. 1.

Referring now to FIG. 10, the stem 43 or 56 of the actuator 45 of FIGS. 1, 3, 4 and 5 is biased by a spring 126 towards position of zero orifice and is directly operated by a lever 127, which provides the external signal 46.

Referring now to FIG. 11, the stem 43 or 56 of the actuator 45 of FIGS. 1, 3, 4 and 5 is biased by a spring 128 towards position of zero orifice and is directly operated by a piston 129. Fluid pressure is supplied to the piston 129 from a pressure generator 130, operated by a lever 131.

Referring now to FIG. 12, the stem 43 or 56 of the actuator 45 of FIGS. 1, 3, 4 and 5 is biased by a spring 132 towards position of zero orifice and is directly operated by a solenoid 133, connected by a line to an input current control 134, operated by a lever 135 and supplied from an electrical power source 136.

Referring now to FIG. 13, the stem 43 of the differential control 13 is biased by a spring 137 towards position, where it isolates the inlet chamber 33 from the exhaust chamber 34 and is controlled by a solenoid 138. The electrical control signal, amplified by amplifier 139, is transmitted from a logic circuit or a micro-processor 140, subjected to inputs 141, 142 and 143.

Referring now to FIG. 14, a logic circuit or a microprocessor 144, supplied with control signals 145, 146 and 147 transmits an external control signal to the differential control 68*a* through an amplifier 148.

Referring now to FIG. 1, the output flow from the fluid pump 10 to the fluid motor 15 is regulated by the output flow control 12 in response to $P_1$ and $P_2$ pressure signals through the flow changing mechanism 11. If pump 10 is of a fixed displacement type, output flow control 12 is a differential pressure relief valve, which in a well known manner, by bypassing fluid from the pump 10 to the reservoir 16, maintains discharge pressure $P_1$ of pump 10 at a level, higher by a constant pressure differential, than $P_2$ pressure signal delivered to the output flow control 12. If pump 10 is of a variable displacement type, pump flow control 16 is a differential pressure compensator, well known in the art, which by changing displacement of pump 10 maintains discharge pressure $P_1$ of pump 10 at a level, higher by a constant pressure differential, than $P_2$ pressure signal delivered to the output flow control 12. Therefore irrespective of the characteristics of pump 10 the load responsive output flow control 12 will always automatically maintain, between two of its control inputs, namely $P_2$ and $P_1$ pressures, a preselected constant pressure differential, irrespective of the variation in its discharge pressure level. Such load responsive output flow controls either in the form of differential pressure relief valve, or in the form of differential pressure compensator, are well known in the art and will be described in greater detail when referring to FIGS. 7, 8 and 9.

In a conventional load responsive system using the differential pressure relief valve, or the differential pressure compensator, the $P_2$ pressure is always the maximum load pressure Pw, developed in one of the fluid motors subjected to maximum load. Therefore, in a conventional load responsive system the pump output flow control will always maintain a constant pressure differential between the pump discharge pressure $P_1$ and the maximum load pressure Pw, irrespective of the magnitude of Pw pressure, maintaining the relationship of $\Delta P = P_1 - Pw = \text{constant}$. Such a system will always maintain a constant pressure differential $\Delta P$ across orifice 14, positioned between system pump and fluid motor. With constant pressure differential acting across the orifice, flow through the orifice will be proportional to the area of the orifice and independent of the pressure level in the fluid motor. Therefore, by varying the area of variable orifice 14 the fluid flow to the fluid motor 15 and velocity of the load W can be controlled, each specific area of variable orifice 14 corresponding to a specific velocity of load W, which will remain constant, irrespective of the variation in magnitude of load W.

In the arrangement of FIG. 1, the relationship between load pressure Pw and signal pressure $P_2$ is controlled by the differential control, generally designated as 13 and orifice 26. Assume that the stem 43, positioned by the actuator 45 in response to external control signal 46, as shown in FIG. 1, blocks completely the metering orifice, isolating the control chamber 33 from the exhaust chamber 34. The control spool 36, with its land 37 protruding into the control chamber 33, will generate pressure in the control chamber 33, equivalent to the preload of control spring 41. Displacement of the stem 43 to the right will move metering slots 40 out of circular bore 42, creating an orifice area, through which fluid flow will take place from the control chamber 33 to the exhaust chamber 34. The control spool 36, biased by the control spring 41, will move from right to left, connecting by throttling slots 38 the inlet chamber 32 with the control chamber 33. Rising pressure in the control chamber 33, reacting on cross-sectional area of control spool 36, will move it back into a modulating position, in which sufficient flow of pressure fluid will be throttled from the inlet chamber 32 to the control chamber 33, to maintain the control chamber 33 at a constant pressure, equivalent to preload in the control spring 41. When displacing metering slots 44 in respect to circular bore 42, the area of the metering orifice will be varied. Since constant pressure differential is automatically maintained between the exhaust chamber 34 and the control chamber 33 and therefore across the metering slots 44 by the control spool 36 each specific area of metering slots 44 will correspond to a specific constant flow level from the control chamber 33 to the exhaust chamber 34 and from the inlet chamber 32 to the control chamber 33, irrespective of the magnitude of the pressure in the inlet chamber 32. Therefore each specific position of stem 43, within the zone of metering slots 44, will correspond to a specific flow level and therefore a specific pressure drop $\Delta Px$ through fixed orifice 26, irrespective of the magnitude of the load pressure Pw. When referring to FIG. 1 it can be seen that $P_1 - Pw = \Delta Py$, $P1_1 - P_2 = \Delta P$, maintained constant by pump control and $Pw - P_2 = \Delta Px$. From the above equations, when substituting and eliminating $P_1$ and $P_2$, a basic relationship of $\Delta Py = \Delta P - \Delta Px$ is obtained. Since $\Delta Px$ can be varied and maintained constant at any level by the differential control 13, so can $\Delta Py$, acting across variable orifice 14, be varied and maintained constant at any level. Therefore, with any specific constant area of variable orifice 14, in response to the control signal 46, pressure differential $\Delta Py$ can be varied from maximum to zero, each specific level of $\Delta Py$ being automatically controlled constant, irrespective of variation in the load pressure Pw. Therefore, for each specific area of variable orifice 14 the pressure differential, acting across orifice 14 and the flow through orifice 14 can be controlled from maximum to minimum by the differential control 13, each flow level automatically being controlled constant by the output flow control 12, irrespective of the variation in the load pressure Pw. From inspection of the basic equation $\Delta Py = \Delta P - \Delta Px$ it becomes apparent that with $\Delta Px = 0$, $\Delta Py = \Delta P$ and that the system will revert to the mode of operation of conventional load responsive system, with maximum constant $\Delta P$ of the output flow control 12. When $\Delta Px = \Delta P$, $\Delta Py$ becomes zero, pump discharge pressure $P_1$ will be equal to load pressure Pw and the flow through variable orifice 14 will become zero, With $\Delta Px$ larger than $\Delta P$ pump pressure $P_1$ will become smaller than load pressure Pw and the load check 21 will seat.

In the load responsive system of FIG. 1, for each specific value of $\Delta Py$, maintained constant by the differential control 13 through the output flow control 12, the area of variable orifice 14 can be varied, each area corresponding to a specific constant flow into the fluid motor 15, irrespective of the variation in the magnitude in the load pressure Pw. Conversely for each specific area of the variable orifice 14 pressure differential $\Delta Py$, acting across orifice 14, can be varied by the differential control 13 through the output flow control 12, each specific pressure differential $\Delta Py$ corresponding to a specific constant flow into the fluid motor 15, irrespective of the variation in the magnitude of the load pressure Pw. Therefore fluid flow into fluid motor 15 can be controlled either by variation in the area of variable orifice 14, or by variation in pressure differential $\Delta Py$, each of those control methods displaying identical control characteristics and controlling flow, which is independent of the magnitude of the load pressure. Action of one control can be superimposed upon the action of the other, providing a unique system, in which, for example, a command signal from the operator, through the use of variable orifice 14, can be corrected by signal 46 from a computing device, acting through the differential control 13.

So far in the above considerations it was assumed that the system pump will respond to the load pressure of fluid motor 15. As is well known in the art, the load pressure signals from fluid motors 15 and 24 are transmitted through the check valve logic system of check valves 25 and 27 and only the highest of the load pressures will be transmitted to system controls. With both motors controlled simultaneously, only the fluid motor controlling the higher load will receive proportionally controlled fluid flow.

Referring now to FIG. 2, a differential control, generally designated as **13*a*, is similar to the differential control 13 of FIG. 1. The variable metering orifice, operated by actuator 45 of FIG. 1 was substituted by fixed metering orifice 42*a*, the pressure regulating section of both controls remaining the same. The differential control 13*a* of FIG. 2 will generate a constant $\Delta Px$ across fixed orifice 26** decreasing, by exactly the same amount, the control pressure differential of the load responsive system. The arrangement of FIG. 2 is very useful to reduce comparatively large controlled pressure differential of output flow control 12 to a lower level, thus increasing system efficiency, while response of output flow control 12 is not affected.

Referring now to FIG. 3, the differential control 13 is identical to the differential control 13 of FIG. 1 and performs in an identical way, by modifying a control signal transmitted to the output flow control 12 of pump 10. However, the differential control 13 of FIG. 3 modifies the control signal of pump discharge pressure $P_1$ instead of modifying the control signal of load pressure Pw, as shown in the system of FIG. 1. In FIG. 3 the control load pressure signal Pw is transmitted directly from fluid motors 15 and 24, through logic system of signal check valves 25 and 27 and line 47 to the output flow control 12. Then, as can be seen in FIG. 3, $P_1-Pw=\Delta Py$, $P_1-P_2=\Delta Px$ and $P_2-Pw=\Delta P$ which, in a manner as previously described, is maintained constant by pump control. From the above equations, when substituting and eliminating $P_1$ and $P_2$, the basic relationship of $\Delta Py=\Delta P+\Delta Px$ can be obtained. Since $\Delta Px$ can be varied and maintained constant at any level so can $\Delta Py$, acting across variable orifice 14, be varied and maintained constant at any level. From inspection of the basic equation $\Delta Py=\Delta P+\Delta Px$ it becomes apparent that with $\Delta Px=0$, $\Delta Py=\Delta P$ and that the system will revert to the mode of operation of conventional load responsive system, with minimum constant $\Delta P$ equal to the pressure differential of output flow control 12. Any value of $\Delta Px$ other than zero will increase the pressure differential $\Delta Py$, acting across variable metering orifice 14 above the level of constant pressure differential $\Delta P$ of output flow control 12. Therefore, the load responsive control arrangement of FIG. 1 will control $\Delta Py$ in a range between $\Delta P$ and zero, while the load responsive control arrangement of FIG. 3 will control $\Delta Py$ in a range above the level of constant pressure differential $\Delta P$ of output flow control 12.

Referring now to FIG. 4, the load responsive control systems of FIG. 1 and FIG. 3 have been combined into a single system. With one differential control 13 made inactive in response to external control signal 49 the other differential control 13, responding to external control signal 46, by modifying load pressure signal, will perform in an identical way, as previously described when referring to the load responsive control of FIG. 1, varying the level of control pressure differential $\Delta Py$ from maximum level of $\Delta P$ to zero. Conversely, with the differential control 13 made inactive in response to external control signal 46, the other differential control 13, responding to external control signal 49, by modifying pump discharge pressure signal will perform in an identical way, as previously described when referring to the load responsive control of FIG. 3, varying the level of control pressure differential $\Delta P$ from minimum level of $\Delta P$ to any desired higher level. Therefore, combined load responsive control of FIG. 4 is capable of controlling the pressure differential $\Delta Py$ from zero to any desired maximum value.

Referring now to FIG. 5, the load responsive system is identical to the load responsive system of FIG. 1 with the exception of a differential control 50, which although different in construction performs in a very similar way as the differential control 13 of FIG. 1. Although the major components of the differential control 50, namely a variable orifice valve 51 and a flow control valve 58, for purposes of better demonstration are shown separated, in actual design they would be combined together and preferably placed within the output flow control 12. The flow control valve 58, of differential control 50, is provided with the housing 59 guiding the metering pin 63, which is subjected to inlet pressure in the inlet chamber 60, to the reservoir pressure in the exhaust chamber 61 and to the biasing force of spring 66. Subjected to pressure in the inlet chamber 60 the metering pin 63 will move from left to right, each specific pressure level corresponding to a specific position of metering pin 63, in respect to the housing 59 and also corresponding to the specific biasing force of spring 66. Each specific position of metering pin 63, in respect to the housing 59, will correspond to a specific flow area of metering slot 64, interconnecting the inlet chamber 60 with the exhaust chamber 61. The shape of metering slot 64 and the characteristics of biasing spring 66 are so selected that variation in the effective orifice area of metering slot 64, in respect to pressure in the inlet chamber 60, will provide a relatively constant flow from the inlet chamber 60 to the exhaust chamber 61. To obtain special control characteristics of the load responsive control the shape of metering slot 64 may be so selected, that any desired relationship between the flow from the inlet chamber 60 and its pressure level can be obtained. Assume that the flow control 58 provides a constant flow from the inlet chamber 60, irrespective of its pressure level. Then, in a well known manner, the flow control 58 could be substituted by a conventional flow control valve, well known in the art. Constant flow to the inlet chamber 60 is supplied from fluid motors 15 or 24 through a logic system of signal check valves 21 and 25, the variable orifice valve 51 and line 67. The variable orifice valve 51, upstream of flow control valve 58, is provided with circular bore 55, Guiding a stem 56, provided with metering slots 57. Displacement of metering slots 57 past circular bore 55 creates an orifice, the effective area of which can be varied by positioning of stem 56 by the actuator 45, in response to external control signal 46. With stem 56 engaging circular bore 55 flow area of variable orifice valve 51 becomes zero. Therefore, in response to external control signal 46, the effective flow area through the variable orifice valve 51 can be varied from zero to a selected maximum value. Since the flow through the variable orifice valve is maintained constant by the flow control valve 58, each specific area of flow through the variable orifice valve 51, in a well known manner, will correspond to a specific constant pressure drop $\Delta Px$, irrespective of the variation in the load pressure Pw. Therefore, the load pressure signal can be modified on its way to the output flow control 12, each value of pressure drop $\Delta Px$, maintained constant by the differential control 50, corresponds to a specific value of pressure differential $\Delta Py$, following the basic relationship of $\Delta Py=\Delta P-\Delta Px$. Therefore, the control characteristics of the load responsive control of FIG. 5 will be identical to those described when referring to FIG. 1, the pressure differential $\Delta Py$ being varied and maintained constant at each specific level by the differential control 50 in response to external control signal 46 between maximum value equal to $\Delta P$ and zero.

In a manner as previously described the shape of metering slot 64 and the biasing force characteristics of spring 66 can be so selected, that any desired relationship between pressure in the inlet chamber 60 and the fluid flow through the variable orifice valve 51 can be obtained. For better purposes of illustration assume that the variable orifice valve 51 of FIG. 5 was substituted by the fixed orifice 42*a* of FIG. 2. Then controlled increase in flow through fixed orifice 42*a*, with increase in the load pressure, will proportionally increase the pressure differential ΔPx and therefore proportionally decrease the pressure differential ΔPy, effectively decreasing the gain of the load responsive control with increase in the load pressure. Conversely, a controlled decrease in flow through fixed orifice 42*a* with increase in the load pressure will proportionally decrease the pressure differential ΔPx and therefore proportionally increase the pressure differential ΔPy, effectively increasing the gain of the load responsive control, with increase in the load pressure. As is well known in the art, the stability margin of most fluid flow and pressure controllers decreases with increase in system pressure. Therefore, the capability of adjusting the system gain, in respect to system pressure, is of primary importance. With the flow control valve 58 the rate of change of pressure differential ΔPy in respect to load pressure does not have to be constant and can be varied in any desired way.

Referring now to FIG. 6, the load responsive system of FIG. 6 is similar to that of FIG. 5 with the exception that variable orifice 14 of FIG. 5 was substituted in FIG. 6 by a load responsive four way valve, generally designated as 68 and a different type of a differential valve 68*a* was used. The differential control 68*a*, which can be substituted by the differential control 13 of FIG. 1, or the differential control 50 of FIG. 5, is connected to load pressure sensing ports 75 and 76 of four way valve 68. With the valve spool 78 in its neutral position, as shown in FIG. 6 load pressure sensing ports 75 and 76 are blocked by the land 80 and therefore effectively isolated from the load pressure existing in load chamber 71 or 72. Under those conditions, in a well known manner, the output flow control 12 will automatically maintain the discharge pressure of pump 10 at a minimum level equal to the load responsive system ΔP. Displacement of the valve spool 78 from its neutral position in either direction first connects with signal slot 86 or 87 load chamber 71 or 72 with load pressure sensing port 75 or 76, while load chambers 71 and 72 are still isolated by the valve spool 78 from the inlet chamber 70 and first and second exhaust chambers 73 and 74. With the variable orifice valve 51 open, the load pressure signal will be transmitted to the output flow control 12, permitting it to react, before metering orifice is open to the fluid motor 15. Further displacement of the valve spool 78 in either direction will create, in a well known manner, through metering slot 83 or 84 a metering orifice between one of the load chambers and the inlet chamber 70, while connecting the other load chamber, through metering slot 82 or 85, with one of the exhaust chambers, in turn connected to the system reservoir 16. The metering orifice can be varied by displacement of valve spool 78, each position corresponding to a specific flow level into fluid motor 15, irrespective of the magnitude of the load $W_1$. Upon this control, in a manner as previously described when referring to FIG. 1, can be superimposed the control action of the differential control 68*a*. The differential valve, generally designated as 68*a*, contains the solenoid, generally designated as 97, which consists of the coil 95 secured in the housing 94 and the armature 96, slidably guided in the coil 95. The armature 96 is provided with conical surface 98, which, in cooperation with sealing edge 99, regulates the pressure differential ΔPx between inlet port 93 and outlet port 103. The comparatively weak spring 101 can be interposed between the armature 96 and the housing 94, to permit a back flow under deenergized condition of the coil 95 from outlet port 103 to inlet port 93. This feature may be of importance, when using a shuttle valve logic system instead of the check valve logic system of FIG. 6. The sealed connector 102 in the housing 94, well known in the art, connects the coil 95 with external terminals, to which the external signal 46 can be applied. A solenoid is an electro-mechanical device, using the principle of electro-magnetics, to produce output forces from electrical input signals. The force developed on the solenoid armature 96 is a function of input current. As the current is applied to the coil 95, each specific current level will correspond to a specific force level transmitted to the armature. Therefore the contact force between the conical surface 98 of the armature 96 and sealing edge 99 of housing 94 will vary and be controlled by the input current. This arrangement will then be equivalent to a type of differential pressure throttling valve, varying automatically the pressure differential ΔPx between inlet port 93 and outlet port 103, in proportion to the force developed in the armature 96, in respect to the area enclosed by the sealing edge 99 and therefore proportional to the external signal 46 of the input current supplied to the solenoid 97. The pressure forces acting on the armature 96, within the housing 94, are completely balanced with the exception of the pressure force due to the pressure differential ΔPx, acting on the enclosed area of sealing edge 99. Since the outlet flow control 12, which will be described in greater detail when referring to FIGS. 7, 8 and 9, contains a bidirectional moving pilot valve, the flow out of the output flow control 12 into line 30 is passed through line 104 and a metering orifice to the reservoir 16. In a well known manner, the flow through the fixed orifice will vary with the load pressure, providing a slow response of the control at low load pressures and high energy loss at high load pressures. Therefore, the orifice in line 104 most likely will be the flow control valve 58, described in detail, when referring to FIG. 5, which will automatically pass a preselectable flow, which may be a function of, or independent of the load pressure, depending on the desired gain of the output flow control 12. When using a logic system of shuttle valves instead of check valves of FIG. 6, line 104 and the flow control valve 58 are not necessary. To simplify the demonstration of the the principle of operation of differential control 68*a* the armature 96 is shown hydraulically unbalanced. In a well known manner venting passage 100 can be connected directly through the cone of conical surface 98 with inlet port 93 and the lower end of venting passage 100 enlarged, to slidably engage a balancing pin, of diameter smaller than diameter of inlet port 93. In this way the effective area subjected to pressure differential is greatly reduced, permitting reduction in the size of the solenoid 97. Such an arrangement is shown by dotted lines in the armature 96 of FIG. 6, the balancing pin being unnumbered.

With the valve spool 78 displaced to any specific position, corresponding to any specific area of metering orifice, the load $W_1$ can be proportionally controlled by action of differential control 68*a*, each value of pressure differential ΔPy being automatically maintained at a constant level by the output flow control 12 and corresponding to a specific flow level into fluid motor 15, irrespective of the magnitude of the load $W_1$. The load $W_2$ is controlled by the direction control valve 90, which may be identical to the direction control valve 68.

Referring now to FIG. 6*a*, a differential pressure controller, generally designated as 68*b*, performs a similar function as the differential pressure controller 68*a*, but is capable of providing, in a well known manner, a fixed pressure differential between inlet port 93 and outlet port 103, this pressure differential being proportional to preload in the spring 101*a*. Control $\Delta P$ of the system will be reduced by this pressure differential providing the controlling pressure differential $\Delta Py$ of a much smaller value. The arrangement of FIG. 6*a* is very useful to reduce comparatively large controller pressure differential of output flow control 12 to a lower level, thus increasing system efficiency, while response of output flow control 12 is not affected.

Referring now to FIG. 7, a load responsive output flow control of a pump is shown. If the pump 10 is of a fixed displacement type, the flow changing mechanism 11 becomes a differential pressure relief valve, well known in the art. If the pump 10 is of a variable displacement type, the flow changing mechanism 11 becomes a differential pressure compensator, well known in the art. The pilot valve 107 on one side is subjected to a load pressure signal 105, together with the biasing force of control spring 115 and on the other side to pump discharge pressure signal which, as shown in FIG. 7, can be modified by the differential control 13. Subjected to those forces, in a well known manner, the pilot valve 107 will reach a modulating position, in which it will control the position of piston 120, to regulate the discharge pressure in discharge line 17, to maintain a constant pressure differential between pressure in space 114 and pressure in control space 106. This constant pressure differential is dictated by the preload in the control spring 115 and is equal to the quotient of this preload and cross-sectional area of the pilot valve 107. The pilot valve 107, in control of flow changing mechanism 11, uses energy supplied by the pump 19.

Referring now to FIG. 8, space 114 is directly supplied from discharge line 17, while the flow changing mechanism 11 uses energy supplied from the pump 12. In conventional control of load responsive system pressure signal 124 is directly supplied from the system load and a small leakage is provided from control space 94. In the load responsive system of this invention load pressure signal is modified by the differential control 13 and becomes pressure signal 124.

Referring now to FIG. 9, the pump control of FIG. 9 is identical to that as shown in FIG. 8, but uses energy supplied from the pump 19. FIG. 9 shows the pump controls connected into a basic system as shown in FIG. 1. The differential control 13 is connected to space 106 and as described when referring to FIG. 1 modifies the control signal to vary the effective pressure differential across an orifice connecting the pump 10 and the load. As previously described in FIGS. 1 and 3–5 the differential control 13 is shown separately connected to the schematically shown output flow control of the pump. As shown in FIG. 9 the components of the differential control 13 would become an integral part of the output flow control of the pump 10.

Referring now to FIG. 10, the stem 43 or 56 of the actuator 45 of FIGS. 1, 3, 4 and 5 is biased by a spring 126 towards position of zero orifice and is directly operated by a lever 127, which provides the external signal 46 in the form of manual input.

Referring now to FIG. 11, the stem 43 or 56 of the actuator 45 of FIGS. 1, 3, 4 and 5 biased by a spring 128 towards position of zero orifice and is directly operated by a piston 129. Fluid pressure is supplied, in a well known manner, to the piston 129 from a pressure generator 130, operated by a lever 131. Therefore the arrangement of FIG. 11 provides the external signal 46 in the form of a fluid pressure signal.

Referring now to FIG. 12, the stem 43 or 56 of the actuator 45 of FIGS. 1, 3, 4 and 5 is biased by a spring 132 towards position of zero orifice and is directly operated, in a well known manner, by a solenoid 133, connected by a line to an input current control 134, operated by a lever 135 and supplied from an electrical power source 136. Therefore the arrangement of FIG. 12 provides the external signal 46 in the form of an electric current, proportional to displacement of lever 123.

Referring now to FIG. 13, the stem 43 of the differential control 13 is biased by a spring 137 towards position, where it isolates the inlet chamber 33 from the exhaust chamber 34. The stem 43 is completely pressure balanced, can be made to operate through a very small stroke and controls such low flows, at such low pressures, that the influence of flow forces is negligible. In any event, if the area of metering slots 44 is so selected that it provides a linear function in respect to displacement of the stem 43 and a constant pressure is maintained in front of the orifice, the flow force will also be linear and will add to the spring force, changing slightly the combined rate of the spring. The stem 43 is directly coupled to a solenoid 138. A solenoid is an electromechanical device using the principle of electro-magnetics to produce output forces from electrical input signals. The position of solenoid armature, when biased by a spring, is a function of the input current. As the current is applied to the coil, the resulting magnetic forces generated move the armature from its deenergized position to its energized position. When biased by a spring, for each specific current level there is a corresponding particular position, which the solenoid will attain. As the current is varied from zero to maximum rating, the armature will move one way from a fully retracted to a fully extended position in a predictable fashion, depending on the specific level of current at any one instant. Since the forces developed by solenoid 138 are very small, so is the input current which is controlled by a logic circuit or a micro-processor 140. The micro-processor 140 will then, in response to different types of transducers, either directly control the system load, in respect to speed, force and position, or can superimpose its action upon the control function of an operator, to perform the required work in minimum time, with a minimum amount of energy, within the maximum capability of the structure of the machine and within the envelope of its horsepower.

Referring now to FIG. 14, the control signal from a logic circuit or micro-processor 144, in a similar way as described in FIG. 13, is directly transmitted through the amplifier 148 to the differential pressure control 68*a*, where, through a solenoid and throttling valve combination, in a manner as previously described, regulates the pressure differential in response to input current.

Although the preferred embodiments of this invention have been shown and described in detail it is recognized that the invention is not limited to the precise form and structure shown and various modifications and rearrangements as will occur to those skilled in the art upon full comprehension of this invention may be resorted to without departing from the scope of the invention as defined in the claims.

What is claimed is:

1. A load responsive fluid control system comprising a pump having an output flow control and a fluid motor subjected to load pressure, control orifice means interposed between said pump and said motor, a control means of said output flow control operable to maintain a pressure differential acting across said control orifice means constant at a predetermined level, said control means having means operable to vary the level of said pressure differential proportionally in response to a control signal while said pressure differential is maintained constant at each controlled level.

2. A fluid control system as set forth in claim 1 wherein said output flow control of said pump includes a bypass flow control means.

3. A fluid control system as set forth in claim 1 wherein said output flow control of said pump includes displacement changing means.

4. A fluid control system comprising a pump having an output flow control and a fluid motor subjected to load pressure, control orifice means interposed between said pump and said motor, first control means having valve means and means operable through said output flow control to maintain a constant pressure differential at a predetermined constant level across said valve means and to maintain a constant pressure differential across said control orifice means, and second control means operable through said first control means to vary the level of said constant pressure differential controlled across said control orifice means while pressure differential across said valve means remains constant at said predetermined constant level.

5. A fluid control system comprising a pump having an output flow control and an outlet, a fluid motor subjected to load pressure, and control orifice means interposed between said outlet of said pump and said fluid motor, control signal transmitting means having means to transmit a first pressure signal from said pump outlet, and means to transmit a second pressure signal from said load pressure, control means of said output flow control of said pump having valve means communicable with said first and said second pressure signals and operable to vary output flow of said pump to maintain a relatively constant pressure differential at a constant predetermined level across said valve means and to maintain a constant pressure differential across said control orifice means, and control signal modifying means of said control signal transmitting means operable to vary the level of said constant pressure differential controlled across said control orifice means while said pressure differential acting across said valve means remains constant at said constant predetermined level.

6. A fluid control system as set forth in claim 5 wherein said control orifice means includes variable area orifice means.

7. A fluid control system as set forth in claim 5 wherein said output flow control of said pump includes a bypass flow control means.

8. A fluid control system as set forth in claim 5 wherein said output flow control of said pump includes pump displacement changing means.

9. A fluid control system as set forth in claim 5 wherein said control signal modifying means has means operable to modify said first pressure signal from said pump outlet to vary the level of said controlled pressure differential across said control orifice means above the level of said constant pressure differential acting across said valve means.

10. A fluid control system as set forth in claim 9 wherein said means operable to modify said first pressure signal includes constant pressure reducing means, orifice means upstream of said constant pressure reducing means, and flow orifice means down stream of said constant pressure reducing means.

11. A fluid control system as set forth in claim 9 wherein said means operable to modify said first pressure signal includes flow orifice means and a flow control means down stream of said flow orifice means.

12. A fluid control system as set forth in claim 9 wherein said means operable to modify said first pressure signal from said pump outlet has means responsive to an external control signal.

13. A fluid control system as set forth in claim 5 wherein said control signal modifying means has means operable to modify said second pressure signal from said load pressure to vary level of said controlled pressure differential across said control orifice means below the level of said constant pressure differential acting across said valve means.

14. A fluid control system as set forth in claim 13 wherein said means operable to modify said second pressure signal includes constant pressure reducing means, orifice means upstream of said constant pressure reducing means and flow orifice means down stream of said constant pressure reducing means.

15. A fluid control system as set forth in claim 13 wherein said means operable to modify said second pressure signal includes flow orifice means and a flow control means down stream of said flow orifice means.

16. A fluid control system as set forth in claim 13 wherein said means operable to modify said second pressure signal from said load pressure has means responsive to an external control signal.

17. A fluid control system as set forth in claim 5 wherein said control signal modifying means has means operable to modify said first pressure signal from said pump outlet and means operable to modify said second pressure signal from said load pressure.

18. A fluid control system as set forth in claim 5 wherein said control signal modifying means has means responsive to an external control signal.

19. A load responsive fluid control system comprising a pump having an output flow control and an outlet, a fluid motor subjected to load pressure, exhaust means, and a direction control valve interposed between said outlet of said pump said fluid motor and said exhaust means, said direction control valve having first valve means for selectively interconnecting said fluid motor with said pump and said exhaust means and for providing control orifice means between said outlet of said pump and said fluid motor, first control means operable through said output flow control of said pump to maintain a pressure differential across said control orifice means at a controlled constant level and second control means operable to vary the level of said constant pressure differential proportionally in response to a control signal.

20. A fluid control system as set forth in claim 19 wherein said control orifice means includes variable area orifice means.

21. A fluid control system as set forth in claim 19 wherein said output flow control of said pump includes a bypass flow control means.

22. A fluid control system as set forth in claim 19 wherein said output flow control of said pump includes displacement changing means.

23. A fluid control system comprising a pump having an output flow control and an outlet, a fluid motor subjected to load pressure, exhaust means, and direction control valve interposed between said outlet of said pump said fluid motor and said exhaust means, said direction control valve having first valve means for selectively interconnecting said fluid motor with said pump and said exhaust means operable to provide control orifice means between said outlet of said pump and said fluid motor, load pressure sensing port means in said direction control valve selectively communicable with said fluid motor by said first valve means, control signal transmitting means having means to transmit a first pressure signal from said pump outlet and means to transmit a second pressure signal from said load pressure sensing port means, control means of said output flow control of said pump having second valve means communicable with said first and said second pressure signal and operable to vary output flow of said pump to maintain a relatively constant pressure differential at a constant predetermined level across said second valve means and to maintain a constant pressure differential across said control orifice means, and control signal modifying means of said control signal transmitting means operable to vary the level of said constant pressure differential controlled across said control orifice means while said pressure differential acting across said second valve means remains constant at said constant predetermined level.

24. A fluid control system as set forth in claim 23 wherein said first valve means has a neutral position in which it blocks said load pressure sensing port means, said first valve means when displaced from said neutral position first connecting said load pressure sensing port means with said control means of said output flow control of said pump before connecting said pump to said fluid motor.

25. A fluid control system as set forth in claim 23 wherein said control orifice means includes variable area orifice means.

26. A fluid control system as set forth in claim 23 wherein said output flow control of said pump includes a bypass flow control means.

27. A fluid control system as set forth in claim 23 wherein said output flow control of said pump includes pump displacement changing means.

28. A fluid control system as set forth in claim 23 wherein said control signal modifying means has means operable to modify said first pressure signal from said pump outlet to vary the level of said controlled pressure differential across said control orifice means above the level of said constant pressure differential acting across said second valve means.

29. A fluid control system as set forth in claim 28 wherein said means operable to modify said first pressure signal includes constant pressure reducing means, orifice means upstream of said constant pressure reducing means and flow orifice means down stream of said constant pressure reducing means.

30. A fluid control system as set forth in claim 29 wherein said orifice means upstream of said constant pressure reducing means has orifice area adjusting means.

31. A fluid control system as set forth in claim 29 wherein said flow orifice means has variable area orifice means.

32. A fluid control system as set forth in claim 28 wherein said means operable to modify said first pressure signal includes flow orifice means and a pressure responsive flow control means down stream of said flow orifice means.

33. A fluid control system as set forth in claim 32 wherein said flow orifice means has variable area orifice means.

34. A fluid control system as set forth in claim 26 wherein said means operable to modify said first pressure signal from said pump outlet has means responsive to an external control signal.

35. A fluid control system as set forth in claim 34 wherein said means responsive to an external control signal includes mechanical actuating means.

36. A fluid control system as set forth in claim 34 wherein said means responsive to an external control signal includes fluid pressure actuating means.

37. A fluid control system as set forth in claim 34 wherein said means responsive to an external control signal includes electro-hydraulic actuating means.

38. A fluid control system as set forth in claim 34 wherein said means responsive to an external control signal includes electro-mechanical actuating means.

39. A fluid control system as set forth in claim 23 wherein said control signal modifying means has means operable to modify said second pressure signal from said load sensing port means to vary the level of said controlled pressure differential across said controlled orifice means below the level of said constant pressure differential acting across said second valve means.

40. A fluid control system as set forth in claim 39 wherein said means operable to modify said second pressure signal includes constant pressure reducing means, orifice means upstream of said constant pressure reducing means and flow orifice means down stream of said constant pressure reducing means.

41. A fluid control system as set forth in claim 40 wherein said orifice means upstream of said constant pressure reducing means includes orifice area adjusting means.

42. A fluid control system as set forth in claim 40 wherein said flow orifice means includes a variable area orifice means.

43. A fluid control system as set forth in claim 39 wherein said means operable to modify said second pressure signal includes flow orifice means and a pressure responsive flow control means down stream of said flow orifice means.

44. A fluid control system as set forth in claim 43 wherein said flow orifice means includes variable area orifice means.

45. A fluid control system as set forth in claim 39 wherein said means operable to modify said second pressure signal from said load sensing port means has means responsive to an external control signal.

46. A fluid control system as set forth in claim 45 wherein said means responsive to an external control signal includes mechanical actuating means.

47. A fluid control system as set forth in claim 43 wherein said means responsive to an external control signal includes fluid pressure actuating means.

48. A fluid control system as set forth in claim 45 wherein said means responsive to an external control signal includes electro-hydraulic actuating means.

49. A fluid control system as set forth in claim 45 wherein said means responsive to an external control signal includes electro-mechanical actuating means.

50. A fluid control system as set forth in claim 23 wherein said control signal modifying means has means operable to modify said first pressure signal from said pump outlet and means operable to modify said second pressure signal from said load pressure sensing means.

51. A fluid control system comprising a fluid pump having an output flow control and an outlet, a multiplicity of fluid motors subjected to load pressures, exhaust means, and a multiplicity of direction control valves interposed between said outlet of said pump, said exhaust means and each of said fluid motors, each of said direction control valves having first valve means for selectively interconnecting one of said fluid motors with said pump and said exhaust means operable to provide control orifice means between said outlet of said pump and one of said fluid motors, load pressure sensing port means in each of said direction control valves selectively communicable with one of said fluid motors by said first valve means, control signal phasing means connected to said load pressure sensing port means of each of said direction control valves and operable to transmit highest load pressure signal to a control pressure zone, control signal transmitting means having means to transmit a first pressure signal from said pump outlet and means to transmit a second pressure signal from said control pressure zone, control means of output flow control of said pump having second valve means communicable with said first and said second pressure signals and operable to vary output flow of said pump to maintain a relatively constant pressure differential at a constant predetermined level acting across said second valve means to maintain a constant pressure differential across said control orifice means of a directional control valve subjected to highest load pressure, and control signal modifying means of said control signal transmitting means operable to vary level of said constant pressure differential controlled across said control orifice means of a direction control valve subjected to highest load pressure while said pressure differential acting across said second valve means remains constant at said constant predetermined level.

52. A fluid control system as set forth in claim 51 wherein said output flow control of said pump includes a bypass flow control means.

53. A fluid control system as set forth in claim 51 wherein said output flow control of said pump includes pump displacement changing means.

54. A fluid control system as set forth in claim 51 wherein said control signal modifying means has means operable to modify said first pressure signal from said pump outlet to vary the level of said controlled pressure differential across said control orifice means above the level of said constant pressure differential acting across said second valve means.

55. A fluid control system as set forth in claim 51 wherein said control signal modifying means has means operable to modify said second pressure signal from said control pressure zone to vary the level of said controlled pressure differential across said controlled orifice means below the level of said constant pressure differential acting across said second valve means.

56. A fluid control system as set forth in claim 51 wherein said control signal modifying means has means operable to modify said first pressure signal from said pump outlet and means operable to modify said second pressure signal from said control pressure zone.

* * * * *